United States Patent [19]

Tallier et al.

[11] Patent Number: 5,003,996

[45] Date of Patent: Apr. 2, 1991

[54] APPARATUS FOR TRIMMING AND COMPRESSION OF TOBACCO

[75] Inventors: Bernard Tallier, Georgier; Otto Hagmann, Neuchatel, both of Switzerland

[73] Assignee: Fabriques de Tabac Reunies, S.A., Neuchatel, Switzerland

[21] Appl. No.: 389,180

[22] Filed: Aug. 3, 1989

[30] Foreign Application Priority Data

Aug. 10, 1988 [CH] Switzerland ..... 3013/88

[51] Int. Cl.[5] ..... A24C 5/14

[52] U.S. Cl. ..... 131/84.2; 131/84.3; 131/84.4

[58] Field of Search ..... 131/84.4, 84.3, 84.2, 131/84.1

[56] References Cited

U.S. PATENT DOCUMENTS

| | | | |
|---|---|---|---|
| 3,318,314 | 5/1967 | Stelzer | 131/84 |
| 3,712,160 | 1/1973 | Preson et al. | 83/4 |
| 4,485,826 | 12/1984 | Holzangel | 131/84 C |
| 4,564,028 | 1/1986 | Heitmann | 131/84.4 |
| 4,729,386 | 3/1988 | Heitmann | 131/84.1 |

FOREIGN PATENT DOCUMENTS

| | | |
|---|---|---|
| 3407893 | 9/1984 | Fed. Rep. of Germany . |
| 2057878 | 5/1971 | France . |
| 2072483 | 10/1981 | United Kingdom . |
| 2179233 | 3/1987 | United Kingdom . |

*Primary Examiner*—V. Millin

*Attorney, Agent, or Firm*—Jeffrey H. Ingerman

[57] ABSTRACT

Combined in a very compact unit (1) are means for trimming and for compressing tobacco during the cycle of formation of a cigarette rod. Dense-end disks (3, 4) are made up of beveled circular cutters in contact (at 21) at their peripheries. The trimmed tobacco drops by the force of gravity into a discharge container without being subjected to buffeting by extraction brushes. The cyclic compression of the cigarette rod at locations corresponding to the tips of cigarettes is carried out by a rotary cam (7) placed slightly upstream and below the dense-end disks.

7 Claims, 4 Drawing Sheets

PRIOR ART

APPARATUS FOR TRIMMING AND COMPRESSION OF TOBACCO

This invention relates to apparatus for the manufacture of tobacco products, and more particularly to apparatus for the trimming and compression of tobacco for forming the cigarette rod, of the type having a pair of rotary dense-end disks, the respective speeds of rotation of which are identical but in opposite directions relative to one another, and compression means placed upstream from the disks relative to the advancing direction of the cigarette rod and capable of compressing the tobacco over a specific length and cyclically on the cigarette rod, the zones of compression corresponding in each case to the tips of the cigarettes.

In the manufacture of cigarettes, one of the first phases is known to consist in the formation of a continuous cigarette rod which is subsequently wrapped in paper before being cut into cigarettes.

This cigarette rod is trimmed and should have "reinforcements" of tobacco at regular intervals over a specific length corresponding in each case to the tips of the cigarettes in order to eliminate the risk of tobacco running out at one or both ends of the cigarette (according to whether it has a filter or not). In other words, this amounts to providing a greater density of tobacco at the ends of the cigarette than in its actual body.

Figure 1:
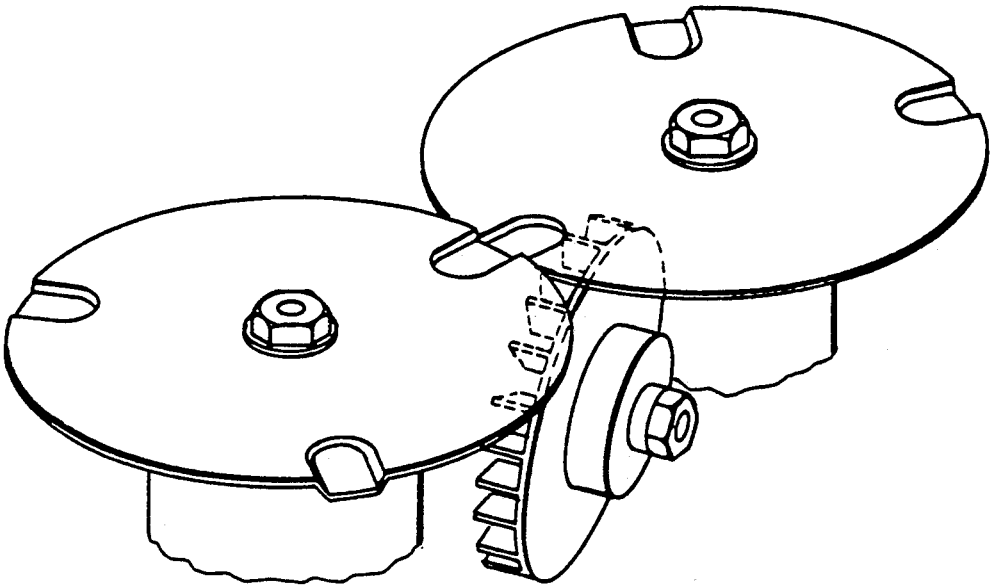

In one prior art apparatus, which will be better understood by referring to FIG. 1 of the accompanying drawings, trimming and reinforcement are obtained by means of a pair of grooved disks. The surplus tobacco, generally within a range of approximately 25–30%, is removed, whereas at regular intervals corresponding to the passage of the cigarette rod through the grooves, this rod will incorporate a larger quantity of tobacco which will be compressed at a later stage, i.e., during the operation of wrapping the cigarette rod. The two disks are not situated in the same plane, but in two slightly shifted parallel planes, nor are they in contact with one another. Arranged below the pair of dense-end disks is an extraction wheel or brush which rotates at a very high speed (app. 5,000–10,000 rpm). The excess tobacco is sent to a discharge container.

This type of apparatus reveals a number of drawbacks. Among them, it will be noted that the tobacco extracted, i.e., separated from the cigarette rod, is handled particularly roughly since it is subjected to substantial forces created by the rotation of the extraction wheel. The resulting buffeting brings about damage through breaking-up of a large number of particles of expanded tobacco. Moreover, particles of tobacco are observed to remain clinging in the corners of the grooves; such dispersion is harmful to an even consistency of the cigarette rod.

In other prior art (U.S. Pat. No. 3,318,314), a cutter or disk (3 and 3', respectively) placed above the conveyor belt trims, while compacting is performed with the aid of a roller reciprocating at right angles to the cigarette rod. As a result of providing only a single cutter or disk and of working above the advancing belt of the rod, this apparatus presents the drawback of ensuring neither an even consistency of the cigarette rod nor a satisfactory distribution of the tobacco fiber. Furthermore, the trimming and compacting means are widely dispersed and unwieldy.

Another prior art apparatus (published U.K. Patent Application No. 2,072,483) comprises as a trimming means two coplanar disks provided with pockets at their peripheries, co-operating with a brush situated below them, in an arrangement analogous to that of FIG. 1. A cam placed upstream from these disks ensures a slight compression of the tobacco at the locations where the disks produce an excess thickness.

According to West German Patent No. 3,407,893, the use of completely flat coplanar disks is already known, but these disks are mounted and actuated to approach and withdraw cyclically from the perforated band which guides and carries along the flow of tobacco. The function of the cyclic compression means is thus performed in this case by the disks themselves, which leads to a complex arrangement of the apparatus.

It is an object of this invention to provide improved apparatus by means of which the drawbacks set forth above may be effectively remedied.

To this end, in the trimming and compressing apparatus according to the present invention, of the type initially mentioned, the dense-end disks consist of circular cutters in contact at their peripheries, and the means ensuring the cycles of compression of the tobacco are disposed under these disks.

The means as a whole are combined in a very compact unit.

Other objects and advantages of the invention will become apparent from the following detailed description of a preferred embodiment thereof, taken in conjunction with the accompanying drawings, in which:

FIG. 1 is an illustration of the prior art previously discussed.

Figure 2:
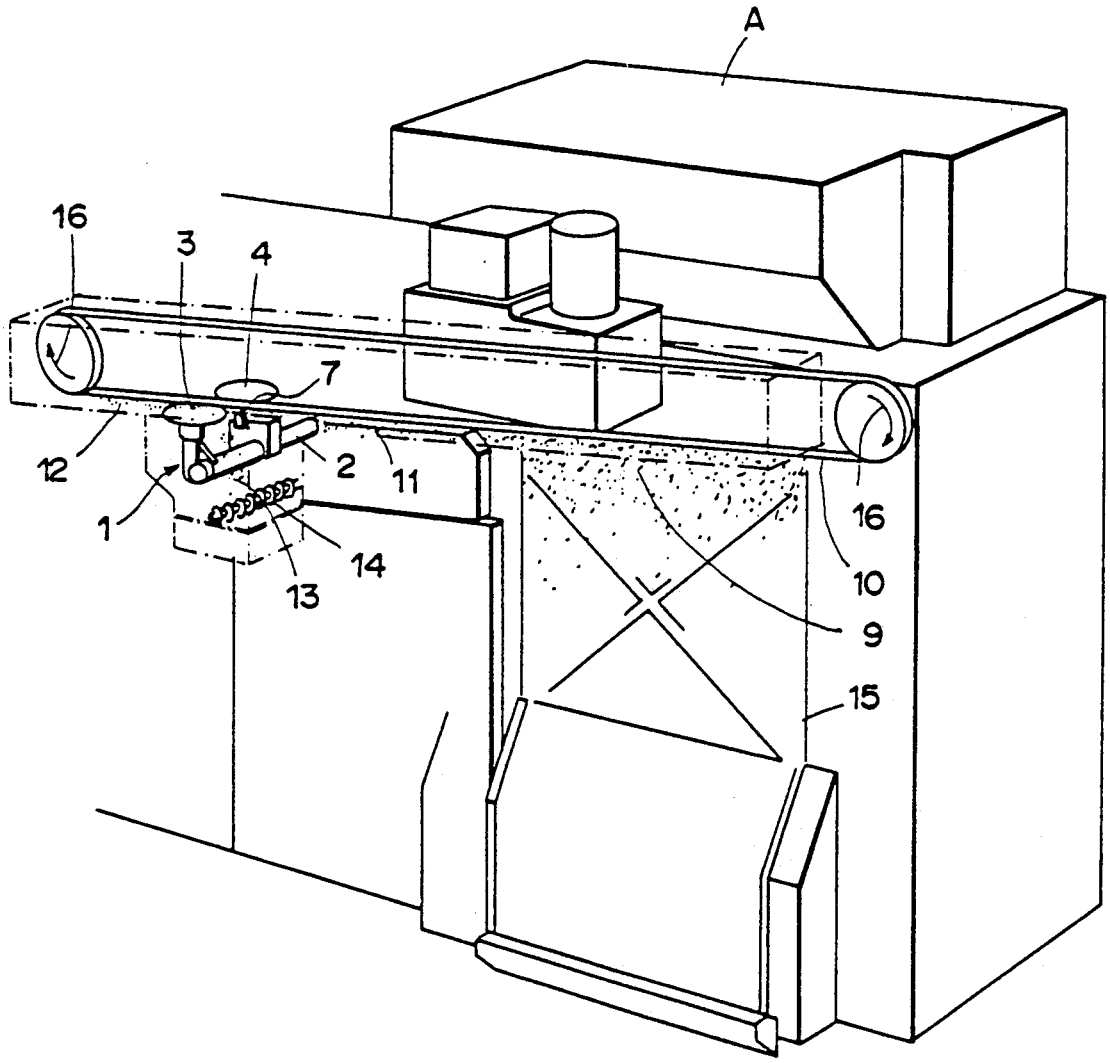
Figure 3:
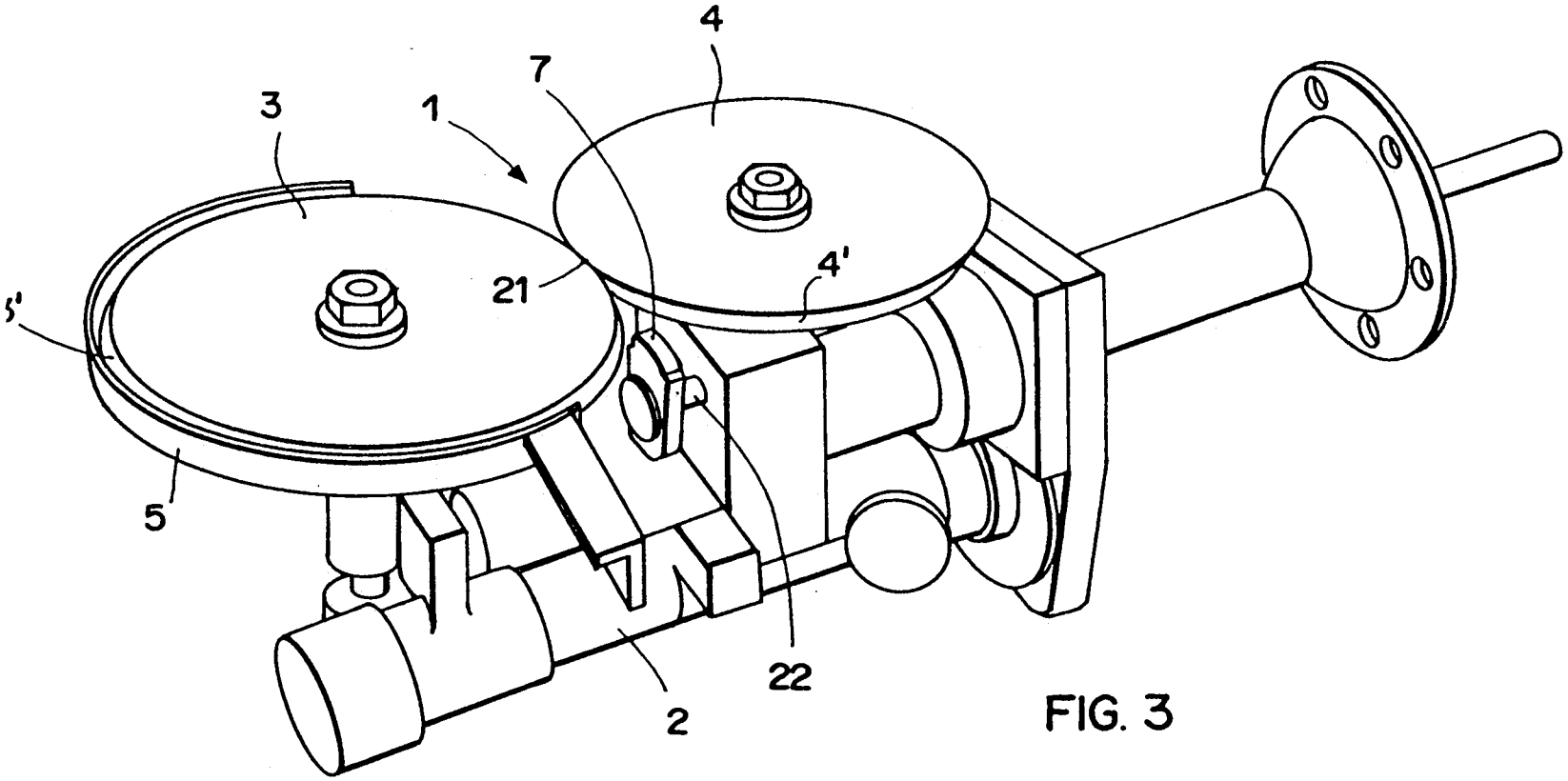
Figure 4B:
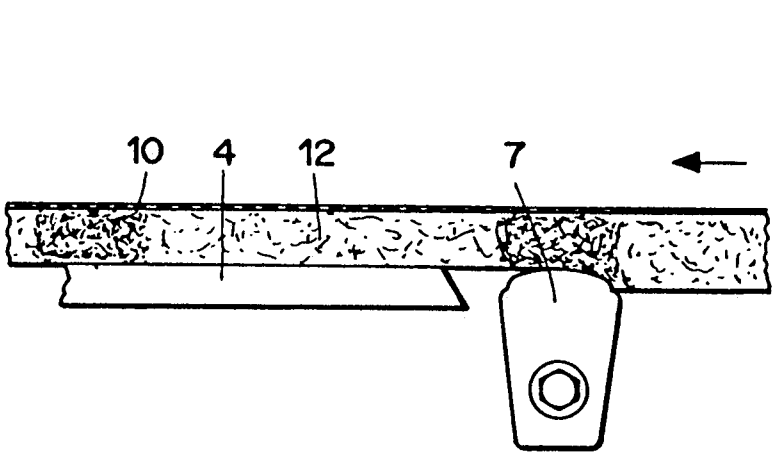
Figure 4A:
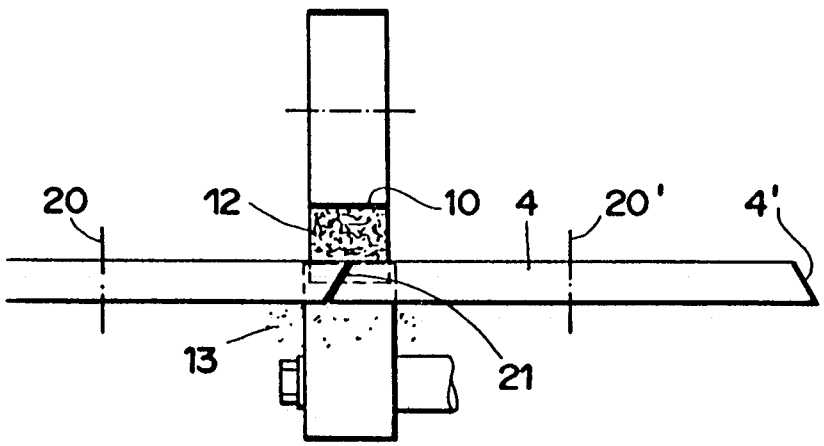
Figure 5B:
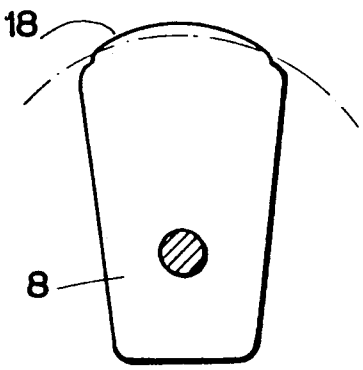
Figure 5A:
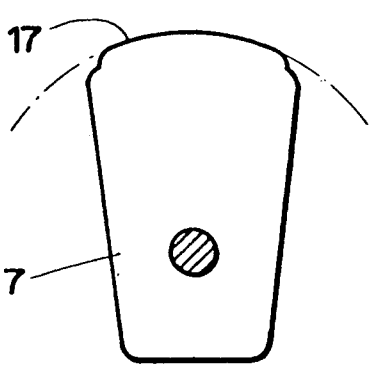
Figure 6A:
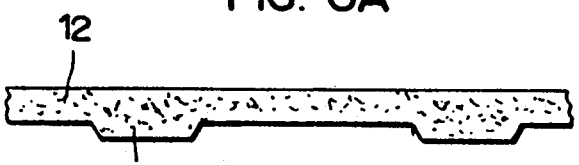
Figure 6B:
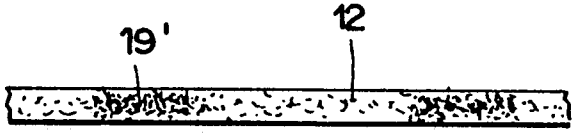

FIG. 2 is a diagrammatic perspective view showing the location of the apparatus in the assembly from which the cigarette rod is formed, FIG. 3 is a perspective view of the compact trimming and compression means unit, FIG. 4A is a partial side elevation on a larger scale of the contact between the cutter disks, FIG. 4B is a diagrammatic front elevation of the disk-cam-rod grouping, FIGS. 5A and 5B are elevations of two compression-cam designs, and FIGS. 6A and 6B are elevations of portions of the cigarette rod showing the reinforcements after trimming and compression.

In FIG. 2, the inventive apparatus 1 is shown diagrammatically and placed under a moving band 10. Band 10 has perforations (not shown) by means of which particles of tobacco 9 from a supply bin 15 are drawn against it by suction. A cigarette rod 11 is thus formed beneath tape 10, which moves in the direction indicated by arrows 16; it is guided by lateral elements (not shown), then passes between band 10 and apparatus 1. The "outgoing" rod 12, i.e., trimmed and pre-compressed at regular intervals corresponding to the tips of cigarettes and consequently having more particles of tobacco at these locations, is ready to be wrapped in cigarette paper. Thereafter, the cigarette rod is cut in the middle of each of the compressed zones to form the individual cigarettes. Surplus tobacco 13 from the trimming operation drops by the force of gravity and is conveyed toward a discharge container (not shown) by means of a worm screw 14.

Trimming and compression apparatus 1 is shown in greater detail in FIG. 3. It will be seen that all the inventive means are grouped in a very compact unit essentially made up of a pair of cutter disks 3, 4, front disk 3 having in addition a guard 5, a rotary cam 7, and a case 2 housing the parts which transmit motion to moving parts 3, 4, and 7.

Disks 3 and 4 are disposed in the same plane and have at their peripheries complementary bevels or chamfers 3', 4', as may be better perceived in FIG. 4A. Their contact area 21 extends along a generatrix of the conical frustum formed by the chamfering of the disks; this generatrix is comprised in the plane formed by the axes of rotation 20, 20'. The dense-end disks perform the function of actual scissors: the "incoming" cigarette rod 11 is thus subjected to clean shearing, so that any additional means of extraction becomes superfluous. As already stated above, the surplus tobacco 13 drops by the force of gravity and is immediately conveyed into a discharge container (not shown); thus there is no chance of its being drawn back in. Buffeting of the particles of tobacco is avoided as well.

Just prior to trimming as described, cigarette rod 11 is cyclically compressed over a certain length by means of a rotary cam 7 (FIG. 4B). This cam is integral with a shaft 22, the axis of which is perpendicular to the direction of travel of the cigarette rod, and is placed slightly upstream from and below trimming disks 3, 4. Cam 7 comprises an active cross-section 17 or 18, the shape of which is designed as a function of the desired result. The apex of active cross-section 17 or 18 (FIGS. 5A, 5B) during the compression phase corresponds approximately to the plane of the disks.

In the example illustrated in FIGS. 5A and 5B, compression of the tobacco takes place once per rotation and extends over a predetermined length which is a function of the geometry of the cam and of the speed of travel of the rod. Depending on the cross-section of the cam, this compression is either uniform over the aforementioned length (cross-section 17 of cam 7 in FIG. 5A) or first increases and then decreases over that same length (cross-section 18 of cam 8 in FIG. 5B). Moreover, it will be obvious that cams effecting more than one compression per rotation, e.g., two or three compressions, may be provided. The "outgoing" cigarette rod 12 therefore has, at regular intervals, zones 19 (FIG. 6A) comprising more tobacco which will be recompressed (19', FIG. 6B) after the paper has been put in place. The appearance of zones 19 is due to the fact that the tobacco of cigarette rod 12, previously compressed by cam 7 or 8, decompresses immediately after passage through the dense-end disks.

The inventive apparatus combines all the trimming and compression means in a very compact unit. Owing to the mode of operation of the disks, which acts as shears carrying out a clean cut of the cigarette rod, and owing to the arrangement of the assembly in a unit placed in a fixed position beneath the perforated band, the apparatus provides a notable improvement in the evenness of the cigarette rod and of the compressed zones. The tobacco particles are treated as gently as possible, any brushing or extraction becoming superfluous. By the same token, any risk of having trimmed tobacco drawn back in is eliminated inasmuch as it is acted upon by simple gravity and will be recovered in a discharge container.

What is claimed is:

1. Apparatus for the trimming and compression of tobacco for forming a cigarette rod, said apparatus comprising:

conveyor means comprising a suction conveyor arranged for conveying on its lower face an endless stream of tobacco;

compression means consisting essentially of a compression part disposed below said conveyor means, said compression part acting on said stream for forming cyclically distributed compression zones in which the stream is uniformly compressed throughout its thickness, each of said zones corresponding to a tip of a cigarette; and cutting means comprising a pair of rotating disks disposed below said conveyor means and downstream from said compression means, said disks having plane upper faces and circular peripheral edges defining a permanent zone of mutual contact acting solely as a cutter for portions of said stream lying between said edges.

2. The apparatus of claim 1 wherein:

said disks have parallel vertical axes of rotation;

said plane faces are both at the same height; and said peripheral edges form complementary bevelled frustoconical surfaces; wherein:

said zone of contact is a common generatrix of said frustoconical surfaces, situated in a plane defined by said axes of rotation.

3. The apparatus of claim 1 wherein said compression part is a rotary cam mounted on a shaft which extends perpendicular to the direction of travel of said conveyor, said cam acting on said stream immediately upstream of said disks.

4. The apparatus of claim 3 wherein said cam includes at least one active cross-sectional zone arranged for contacting and compressing said stream during rotation of the cam.

5. The apparatus of claim 4 wherein said at least one active zone is arranged for periodically contacting and compressing said stream only at said cyclically distributed compression zones.

6. The apparatus of claim 5 wherein each of said at least one active zone has the shape of an arc of a circle centered on said cam shaft, thus providing in each of said compression zones of the stream a uniform compression of the stream over a predetermined length of the stream.

7. The apparatus of claim 5 wherein each of said at least one active zone has a shape adapted to provide in each of said compression zones of the stream an at first increasing and then decreasing compression over a predetermined length of the stream.

* * * * *